US010661984B2

(12) United States Patent
Chan et al.

(10) Patent No.: US 10,661,984 B2
(45) Date of Patent: May 26, 2020

(54) UNIVERSAL TRASH COMPACTOR

(71) Applicants: Chung Wah Chan, Houston, TX (US); Ricardo J. Perez, Houston, TX (US)

(72) Inventors: Chung Wah Chan, Houston, TX (US); Ricardo J. Perez, Houston, TX (US)

(73) Assignee: Avangard Innovative LP, Houston, TX (US)

( * ) Notice: Subject to any disclaimer, the term of this patent is extended or adjusted under 35 U.S.C. 154(b) by 539 days.

(21) Appl. No.: 15/250,424

(22) Filed: Aug. 29, 2016

(65) Prior Publication Data

US 2018/0057259 A1 Mar. 1, 2018

(51) Int. Cl.

| | |
|---|---|
| ***B65F 1/14*** | (2006.01) |
| ***B30B 9/30*** | (2006.01) |
| ***B30B 15/14*** | (2006.01) |
| ***B30B 15/28*** | (2006.01) |

(52) U.S. Cl.

CPC ..... *B65F 1/1405* (2013.01); *B30B 9/306* (2013.01); *B30B 15/14* (2013.01); *B30B 15/28* (2013.01); *B65F 2210/12* (2013.01); *B65F 2210/128* (2013.01); *B65F 2210/138* (2013.01); *B65F 2210/168* (2013.01); *B65F 2210/182* (2013.01); *B65F 2210/184* (2013.01)

(58) Field of Classification Search

CPC .... B30B 1/02; B30B 1/06; B30B 1/10; B30B 1/14; B30B 15/14; B30B 9/3042; B30B 9/3046; B65F 1/1405; B65F 2210/12

See application file for complete search history.

(56) References Cited

U.S. PATENT DOCUMENTS 5,025,719 A * 6/1991 Thomas ..... B30B 1/006 100/226
7,146,294 B1 12/2006 Waitkus, Jr.
7,406,402 B1 7/2008 Waitkus, Jr.
(Continued)

FOREIGN PATENT DOCUMENTS

CN 101482742 B * 8/2011
WO 2010095958 A1 8/2010
(Continued)

OTHER PUBLICATIONS

Translation of WO 201513579 to Chen Songhua.*
(Continued)

*Primary Examiner* — Elaine Gort
*Assistant Examiner* — Christopher B Wehrly
(74) *Attorney, Agent, or Firm* — Gregory L. Porter; Hunton Andrews Kurth LLP

(57) ABSTRACT

Disclosed are embodiments that relate to apparatus for compacting materials. The apparatus comprising a mechanical linkage designed to be mounted within the interior of an existing waste receptacle, a compression surface operably connected to the mechanical linkage, and a motor operably connected to the mechanical linkage, wherein the motor is capable of extending and retracting the mechanical linkage, thereby lowering and raising the compression plate. Some embodiments will take advantage of integrated sensors and processors in order to capture and analyze large amounts of data related to the compactor operations. This data may lead to refinements and greater efficiency in the waste disposal processes.

19 Claims, 7 Drawing Sheets

(56) References Cited

U.S. PATENT DOCUMENTS

| | | | | |
|---|---|---|---|---|
| 7,957,937 | B2 | 6/2011 | Waitkus, Jr. | |
| 2002/0108507 | A1* | 8/2002 | May | B30B 9/3007 100/45 |
| 2011/0056393 | A1 | 3/2011 | Kachkovsky | |
| 2015/0350610 | A1* | 12/2015 | Loh | H04N 7/183 348/143 |

FOREIGN PATENT DOCUMENTS

| | | | | |
|---|---|---|---|---|
| WO | 2015130747 | A1 | 9/2015 | |
| WO | WO-2015135279 | A1 * | 9/2015 | B65F 1/1405 |

OTHER PUBLICATIONS

Translation of CN-101482742-B (Year: 2009).*
Int'l Search Report & Written Opinion (PCT/US2017/045294), dated Oct. 10, 2017.

* cited by examiner

UNIVERSAL TRASH COMPACTOR

FIELD

Embodiments described herein are employed for upgrading an existing trash receptacle in order to give it trash compacting capabilities. Embodiments allow for increased efficiency when disposing of materials and increased or automatic data gathering from the compacting device.

BACKGROUND AND SUMMARY

The disclosed invention facilitates compacting of materials in existing trash receptacles. A great number of public trash receptacles, trash bins, trash containers, etc. are predominantly filled with light weight, air-filled packaging waste such as paper bags, paper and/or cardboard boxes, drink cups, Styrofoam materials, straws, paper wrap and/or other common waste materials. This waste typically contains significant amounts of air and occupies a large volume of the waste receptacle relative to the weight of the materials. What is needed is a device to reduce the volume of typical waste materials by compressing the waste materials in existing trash receptacles so that each receptacle can hold many times more waste in the original receptacle. This compression greatly reduces the number of trips to empty a receptacle, reduces the total amount of bags and time needed to maintain a trash receptacle with sufficient volume available for additional waste material, reduces the number of trips needed to transport waste materials to a landfill, and reduces the total utilized landfill space.

Disclosed embodiments allow automatic data gathering from a waste receptacle via information technology, so that collected data can be used to increase material handling efficiency. This may be accomplished by prompting an operator to empty the waste receptacle at an appropriate time, ensuring only full or generally full waste receptacles are emptied, or a variety of other actions. This may reduce or even eliminate the amount of time needed to periodically check whether or not a receptacle needs to be emptied. The addition of information technology also adds visibility to the trash receptacles and allows analysis of how much, and in some cases, what kinds of trash are being disposed of at various locations. By gathering and analyzing large amounts of data, patterns and trends may be detected and operations optimized accordingly.

Some disclosed embodiments integrate weight sensors, computer processors, cameras and other sensing devices with the disclosed compactor. The gathered data may be pushed to a cloud or local database for future analysis.

Additional benefits relate to allowing an operator to set the tolerance of compressed weight or volume for each receptacle before signaling that the receptacle needs to be emptied; letting an operator know when trash bags and/or other related materials are running low; letting an operator know when the compactor needs service or maintenance; letting an operator know when full load is approaching and/or how many full loads have been collected, thereby facilitating the pre-scheduling of waste load pick up; customized alerts can be sent to an operator (and multiple other designated personnel) based on predefined criteria; providing multi-layer password protection and optional image capturing devices to capture and analyze images of the material being disposed of for future analysis.

DETAILED DESCRIPTION

Figure 1:
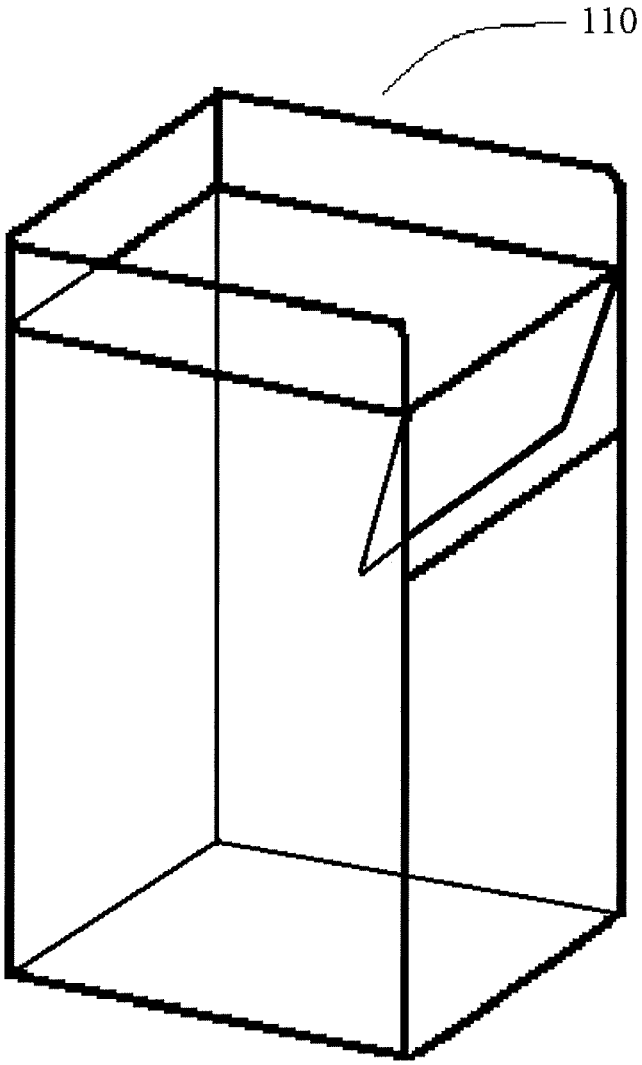
FIG. 1 shows a perspective view of a traditional waste receptacle.
Figure 2:
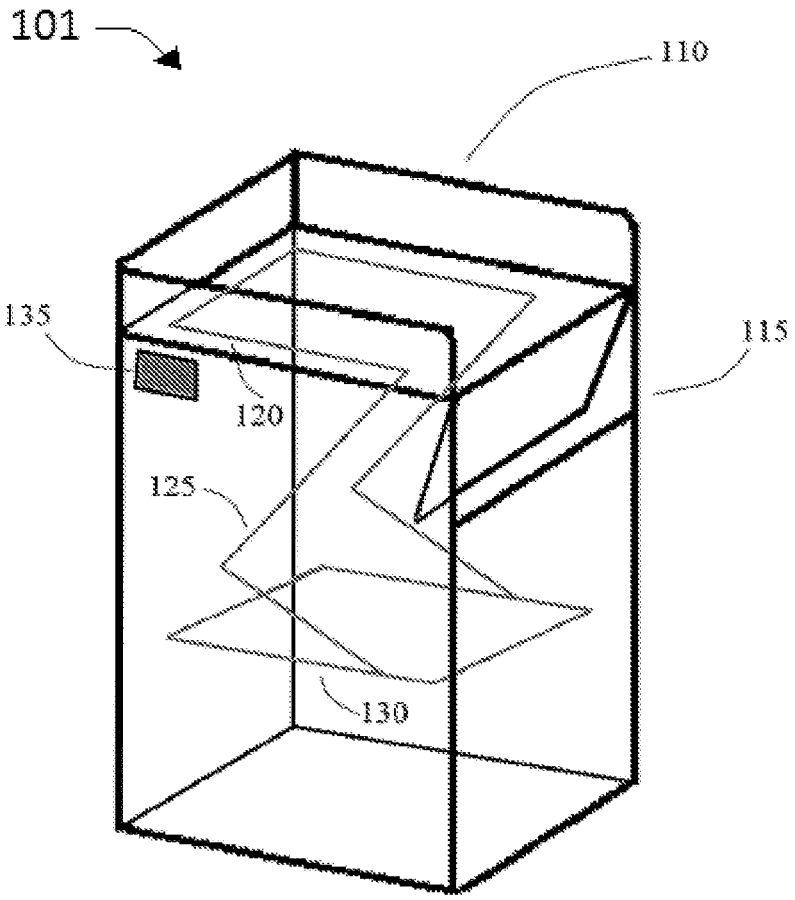
FIG. 2 shows a perspective view of waste receptacle equipped with one possible embodiment of a compactor in an extended position.
Figure 3:
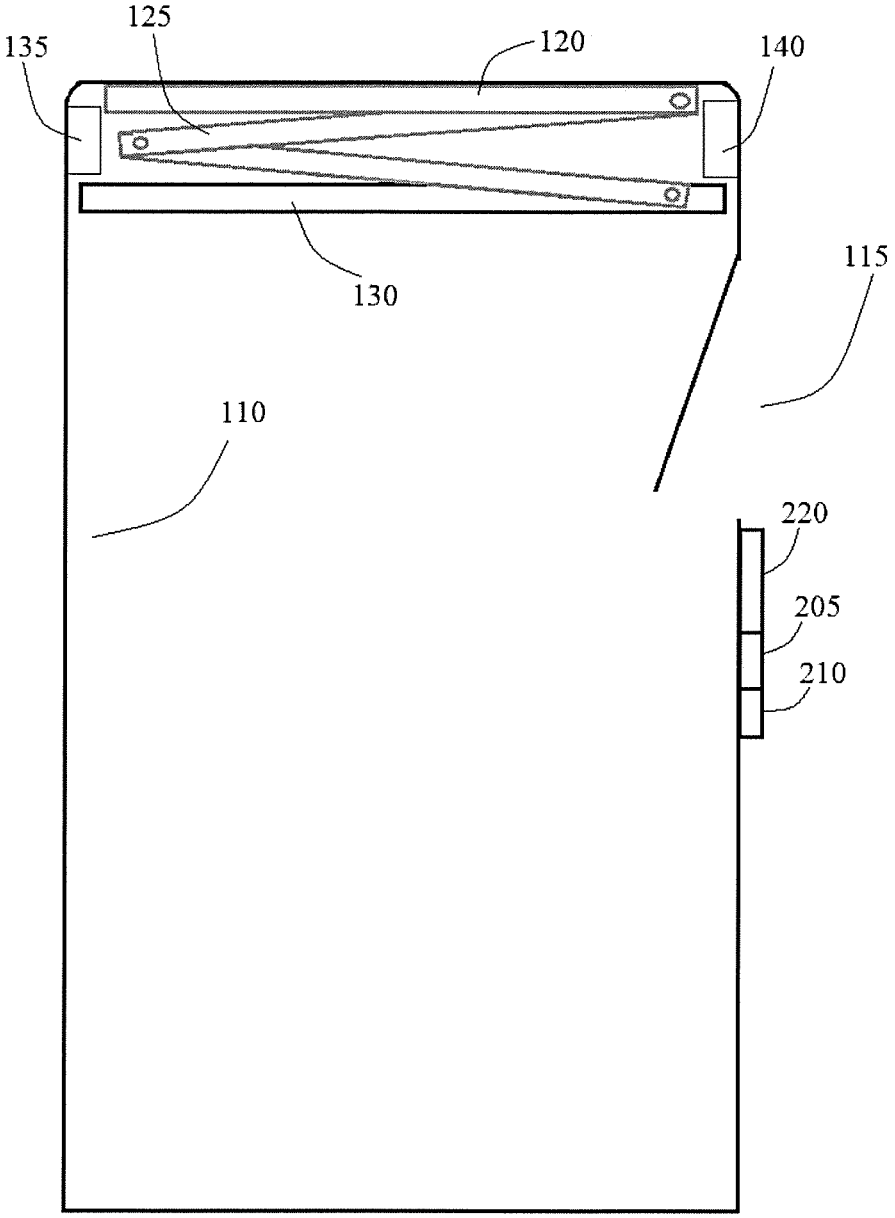
FIG. 3 shows a side view of waste receptacle equipped with one possible embodiment of a compactor in a retracted position.
Figure 4:
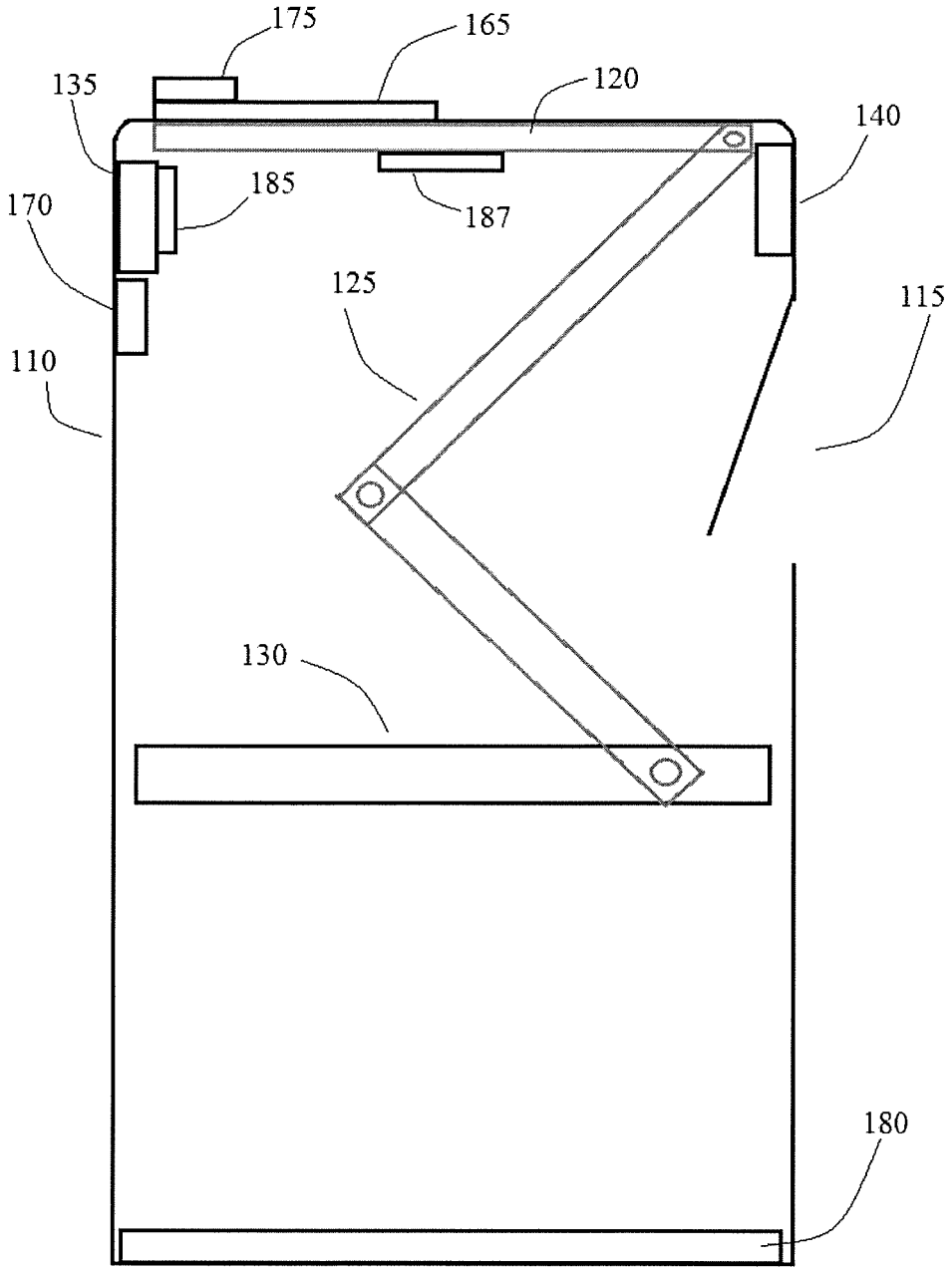
FIG. 4 shows a side view of a waste receptacle equipped with one potential embodiment of a compactor in an extended position.
Figure 5:
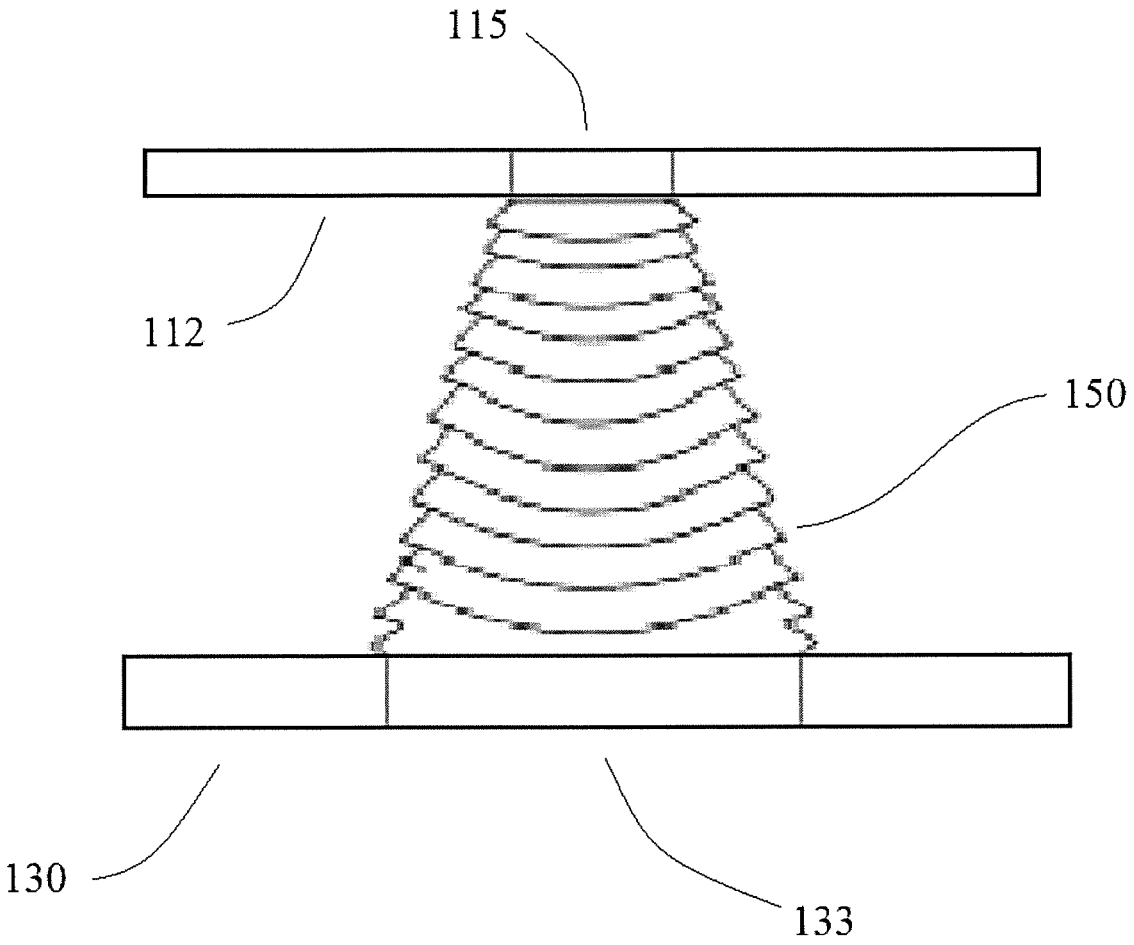
FIG. 5 depicts an alternate embodiment of a compactor in an extended position.
Figure 6:
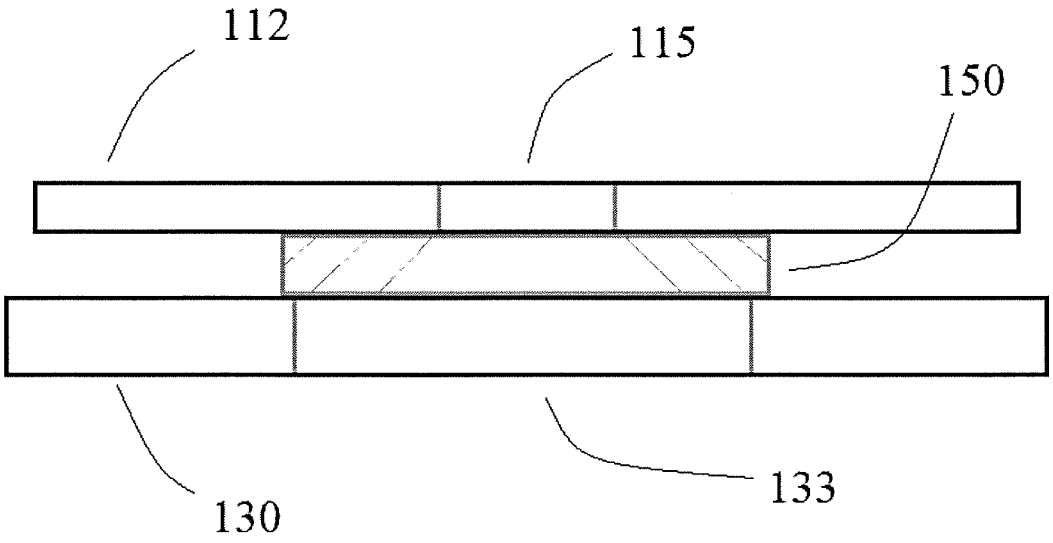
FIG. 6 depicts an alternate embodiment of a compactor in a retracted position.
Figure 7:
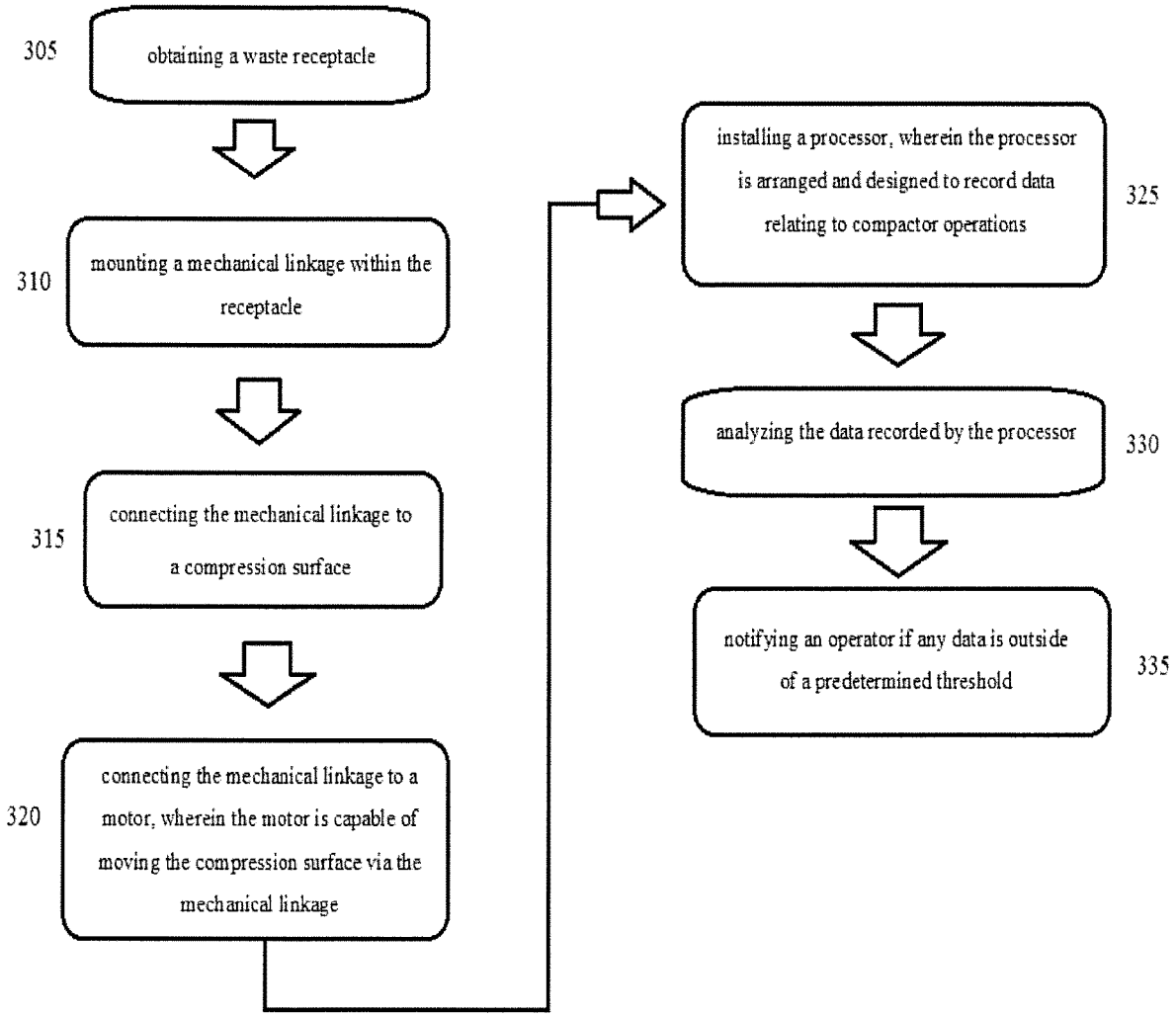
FIG. 7 shows potential steps in a method for converting an existing receptacle into a compactor.

Disclosed embodiments allow for the addition of compactor capabilities into existing trash receptacles 110. Some embodiments also include the addition of information technology, processors 140, imaging devices 170, and/or multiple other sensors to assist in data acquisition and analysis related to waste disposal.

Embodiments of the disclosed compactor apparatus include at least a motor 135, mechanical linkage 125 and a compression surface 130. These components are installed within an existing trash receptacle 110 in order to provide compacting capabilities. It will be appreciated that minor adjustments to the compactor design will be required based on the specific existing receptacle 110 being utilized and the location of the waste opening 115 within that receptacle. A key distinguishing feature is whether the waste opening 115 is located on the side of the receptacle 110 or the top of the receptacle 110.

The motor 135 will typically be electrically powered but may be powered by gas, diesel, solar, or any other suitable power source. The motor 135 will frequently be less than one foot in any dimension but may be any suitable size and may be used to generate any suitable force depending on the conditions and applications. The motor 135 used in fast food applications will likely be much smaller and less powerful than the motor 135 used in larger industrial application. The motor 135 and its components may be made of metal or plastic or any other suitable material depending on the conditions and applications. Some of the many factors that will be considered for a particular application are the expected volume of waste or recyclable materials to be compacted per day; the type of materials to be compacted, particularly the force needed to compress the materials, the potential for the materials to damage the compactor, the chemical and physical properties of the materials, the location of the compactor, and the expected processing of materials after they are compacted, among many others. The motor 135 will commonly be mounted within the receptacle 110, but may be mounted externally, or even remotely from the receptacle 110. In these alternative embodiments, force from the motor 135 may be transferred to the compression surface 130 directly or indirectly via the mechanical linkage 125. If the motor is located remotely from the material to be compressed, the mechanical linkage will typically be much more complex than when the motor is mounted within the receptacle. In alternate embodiments, the motor may be a hydraulic pump, typically driven by an electric motor, used to actuate a hydraulic cylinder.

The mechanical linkage 125 will most commonly be made of metal or plastic, but may be made of any suitable material depending on the conditions of a particular application. The linkage 125 will often be made of thin metal or plastic members, fastened together such that the linkage 125 as a whole can expand and/or retract. This may be done using pin connections that allow the metal or plastic members to pivot relative to each other similar to a scissor lift mechanism. The mechanical linkage 125 may alternatively use telescoping tubular members or any other suitable mechanism for transferring force from the motor 135, either directly or indirectly, to the compression surface 130. In an alternative embodiment, the mechanical linkage 125 may be a rope, chain, or cable that supports a weight, wherein the weight applies pressure to the compression surface 130 or wherein the weight is the compression surface 130. In this embodiment, the motor 135 may lower the weight using the rope, chain, cable, or other similar device in order to allow the force of the weight to compress the waste material. The motor 135 may then retract the weight once the compression is deemed complete. In, additional embodiments, hydraulic pistons or cylinders may be used as the mechanical linkage. In these embodiments, a motor or pump actuates the hydraulic cylinder which transfers the force generated by the motor or pump to the compression surface. The mechanical linkage 125 will typically transfer force from the motor 135 to the compression surface 130 in a vertical direction but may also be configured to apply force horizontally, or in any direction depending on the specific conditions and application. The mechanical linkage 125 will often be mounted within the receptacle 110 but may be mounted in any suitable location such that the linkage 125 can transfer force from the motor 135 to the compression surface 130. This may include mounting the linkage externally of the receptacle or even independent of the receptacle. In some embodiments, the mechanical linkage 125 maybe mounted to the bottom of the receptacle 110 or the floor outside of the receptacle 110 and the motor 135 will cause the compression surface 130 to be pulled down towards the lower mounted mechanical linkage 125 as opposed to pushing the compression surface 130 down away from the top mounted linkage 125.

The compression surface 130 may be made of a wide variety of materials. Most commonly the surface 130 will be metal or plastic, but may be wood, ceramic, cloth, rubber, or any other suitable material depending on the conditions and application. The compression surface 130 will commonly have a large surface area, slightly smaller than the cross section of the receptacle, and be relatively thin, however, the compression surface 130 may be any shape, size, and/or level of stiffness depending on the application. In a common fast food application, depending on the receptacle 110 used, the compression surface 130 will likely have a ridged and substantially flat surface. In other applications, a curved and/or flexible surface may be better suited to the particular conditions. The compression surface 130 will often be only slightly smaller in cross sectional area than the receptacle, but in some applications, it may be desirable to compress materials in a smaller area within the receptacle 110 or, alternatively, only around the outer edge of the receptacle. In these alternative embodiments, the compression surface 130 may be in the shape of a ring or square or any other shape with a substantially hollow interior. In other embodiments, the compression surface 130 may not be flat but may be curved, conical, or have different elevations in any configuration suitable to the application.

The receptacle 110 may be any size, shape and materials but will most commonly be round or rectangular and made of wood, plastic, or metal. Many embodiments will utilize receptacles 110 appropriate for fast food applications, wherein the receptacle 110 is between 30 and 100 gallons in volume, but the receptacle 110 may be significantly larger or smaller depending on the specific conditions and application. The receptacle may be as large at 150 gallons, 200 gallons, 500 gallons, 1000 gallons, or even larger depending on the application. The receptacle may also be as small as 80 gallons, 50 gallons, 20 gallons, or smaller depending on the application. The receptacle 110 will often be a container enclosed on the top and bottom and all sides, but any container, capable of storing waste or recyclable materials may be used as a receptacle 110. The receptacle 110 need not have an enclosed top or be enclosed on all sides. In alternative embodiments, the receptacle may comprise a secondary space. In these embodiments, material may be collected in the receptacle, and the compression surface may compress the material into the secondary space. These and other embodiments may utilize horizontal compression. In some embodiments, the secondary space of the receptacle may be located behind a wall or otherwise out of view of customers. This may allow customers to dispose of materials in one location and staff to remove the compressed materials from a separate location. The receptacle 110 will often be mounted to the floor but may be mounted to a wall or not mounted in a fixed position depending on the conditions and applications. In some instances, the receptacle will be fitted with rollers or wheels in order to make the receptacle and compactor generally portable.

For embodiments installed in receptacles 110 with the waste opening 115 on the side, the motor 135 and mechanical linkage 125 may be installed on the underside of the top of the receptacle 112, thereby concealing the mechanism within the interior of the receptacle 110. When the linkage 125 is retracted, the compressing surface 130, mounted to the linkage 125 is also retracted into the upper portion of the receptacle 110. As waste material is disposed within the receptacle 110, the motor 135 activates and (periodically, in response to a signal from a sensor, or by some other signal) extends the linkage 125 and thus the compression surface 130. Because the linkage 125 is mounted to the upper portion of the receptacle 110, as the linkage 125 extends, the compression surface 130 is pressed lower into the receptacle 110. This action compresses any waste that has accumulated above the level that the compression surface 130 extends down to when the linkage 125 is fully extended. In some embodiments, the full extension of the linkage 125 may only extend approximately half way into the receptacle 110. In other embodiments, the linkage 125 may extend to the bottom of the receptacle 110 depending on the amount of waste material in the receptacle 110 at the time. As the linkage 125 is extended, the compression surface 130 will compress any waste material that it makes contact with until the material is either below the maximum extension of the linkage 125, or the waste material is compressed to a pre-determined threshold. This pre-determined threshold may be established by the power output of the motor 135; the amount of force detected by a compression sensor; the ratio of weight to volume of the waste material as calculated by a volume sensor 185, scale 180, and an associated processor 140; the number of times the compression surface 130 is extended, or any other method.

Once the waste material has been compressed, the linkage 125 retracts, drawing the compression surface 130 back up to the upper portion of the receptacle, thereby allowing additional waste material to be added to the receptacle 110.

In certain embodiments, the compression surface 130 may be arranged to tilt as it is retracted in order to allow any waste material that was added while the compression surface 130 was extended to fall off of the compression surface 130 and land on top of the recently compacted material. In these embodiments, there is no need to restrict the addition of waste materials during the compression process. In most embodiments, the movement of the compactor will take less than two minutes and in some cases less than thirty seconds.

For embodiments installed in receptacles which utilize a waste opening 115 in the top of the receptacle 110, the motor 135 and mechanical linkage 125 are installed on the underside of the top of the receptacle 110 as described above. In certain embodiments, a modified compression plate 130 with a hole through it may be used. The hole should be generally aligned with the waste opening 115 in the top of the receptacle 110. In some embodiments, both the waste opening 115 and the hole in the compression surface 130 will be circular and centered on the same center line. With this slight modification, the compactor 101 operates as described above. The motor 135 extends the linkage 125 which causes the compression surface 130 to be lowered into the receptacle 110. The compression surface 130 compacts any waste material that is above the maximum extended position of the compression surface 130 and then the motor 135 retracts the linkage 125, thereby drawing the compression surface 130 back to the upper portion of the receptacle 110. When the compression surface 130 is retracted to its highest position, where it remains until the next compression cycle, the hole in the compression surface 130 allows waste to pass through the waste opening 115 and through the compression surface 130 as it is disposed of in the receptacle 110. A typical user may be entirely unaware that the receptacle 110 has compacting capabilities when disposing of waste.

In some embodiments, the compression surface 130 may tilt to the side as it is retracted as described above, thereby allowing any waste that was added while the compression surface 130 was in a lower, extended position to fall off the surface 130 and onto the already compressed material.

In a preferred embodiment, a collapsible skirt 150 may be employed to form a channel preventing waste from landing on top of the compression surface 130 when it is in a lowered position. The skirt 150 may be plastic, rubber, cloth, composite or any other material suitable for the purpose. The upper end of the skirt 150 should be substantially sealed around the waste opening 115, underneath the top of the receptacle 112 within the interior of the receptacle 110. The lower end of the skirt 150 should be substantially sealed around the hole in the compression surface 130. The skirt 150 is designed to collapse and/or fold, preferably in an accordion fashion, so that it may be extended and retracted many times over the life of the device. When the skirt 150 is retracted it should return to an organized position and not block the waste opening 115 of the receptacle 110 or become entangled in the mechanical linkage 125. By preventing waste from ever being disposed of on top of the compression surface 130, the compactor 101 can be used anytime without disrupting the customer experience of throwing away waste material.

Many disclosed embodiments take advantage of smart technology such as integrated scales 180, processors 140, volume sensors 185, pressure measuring sensors, input devices, imaging devices 170, printers 175 and more. These embodiments help ensure that data can be collected for analysis of the operations of a compactor 101 and that the collected data can be used to increase material handling efficiency. Disclosed embodiments add ease, transparency and functionality to the measurements of compactor productivity by identifying which compactors are used more at which locations, what types of materials are most commonly disposed of, as well as when waste materials are typically disposed of at each location. This data may be analyzed at a highly granular level, such as identifying what materials are disposed of for an individual compactor, or may be aggregated for use in enterprise level strategic decisions.

Traditional compacting devices commonly include a large hollow space within the trash receptacle 110. This space is typically lined with a trash bag which allows for easy and hygienic removal of the waste materials collected in the receptacle 110. In some disclosed embodiments, the receptacle 110 may contain an interior trash container to which may be lined with a trash bag in order to facilitate removal of the materials from the receptacle 110. Traditional compactors included little to no information technology with the possible exception of a timer which causes the compacting mechanism to activate.

A smart compactor may include a computer processor 140 which may be operably connected to a scale 180, display screen, imaging device 170 such as a digital or video camera, as well as multiple other sensors and/or compactor controls. Additionally, the dimensions of the receptacle of each compactor may be entered into the processor 140, along with various other known metrics for use by the processor 140 in data analysis.

Some disclosed embodiments will provide a minimum weight indicator 205 and a maximum weight indicator 210. Embodiments may also contain a separate or integrated weight display 220 which provides the operator with the current weight of the material being compacted and/or a density measurement of the materials generated by dividing the weight of the materials by the calculated volume of the compressed materials.

Disclosed embodiments address a wide array of concerns by incorporating sensors, imaging devices 170, and computer processors 140, with compactors in order to increase the amount and reliability of data collected. In some embodiments, a scale 180 detects the weight of compressed material and, in certain embodiments, that data is pushed to a cloud based database. Additionally, a local computer processor 140 may capture weight data for local storage. An imaging device 170 may capture images of the waste material before and/or after it is compressed. A local processor 140 may be operably connected to an input device 165 which allows the operator to input data that may not be readily detectable by certain embodiments. The input device 165 will commonly be a keyboard or touch pad, but a mouse, track pad, magnetic card reader, barcode scanner, QR code scanner, RFID reader or other input device 165 may also be used.

Disclosed embodiments may also comprise a printer 175. The printer 175 will commonly be a label printer. The label printer 175 may print up to all known data regarding a compressed bag of waste material and may also encapsulate this data in the form of a tracking device such as a barcode, QR code or RFID chip. An operator can attach the printed label to the compacted bag of waste material. In preferred embodiments, the label printer 175 will print onto adhesive stickers so that the labels may be quickly adhered to the bags or other compressed waste material containers without the need for an additional attachment mechanism. This may allow for the integration of a system of checks and balances confirming information such as the total weight and/or volume of all compressed material being disposed of at a given location. This information may be cross-checked with the invoicing of a third party waste removal service in order to confirm the accuracy of the invoicing. This information may also reveal opportunities for cost-saving or even revenue generating activities related to disposing of the collected and compressed waste materials.

By centralizing all of this data at a single point or database, such as a cloud database, a coordinated and detailed analysis of all waste materials for a given enterprise can be created and maintained with relatively little human input. This data may also be accessible at any time and/or from any location by logging into the database remotely. This big data approach to managing waste materials allows for the identification of inefficiencies at both individual compactors as well as enterprise wide operations.

A typical compactor may be located at a fast food restaurant. As patrons of the restaurant dispose of waste materials into the waste receptacle 110 the integrated scale 180 may register and record the amount of waste deposited. An integrated distance sensor 187 may be used, along with the known dimensions of the receptacle 110, to determine the approximate volume of compressed and/or uncompressed waste materials that have been deposited as well. The compactor may be set to activate the compacting mechanism periodically, at a predetermined weight threshold, at a predetermined volume threshold, when manually activated by an operator, or a combination of any of these factors.

While the compression surface 130 is compacting the waste material, the patrons can typically place additional material into the receptacle. This newly added material will rest on top of the compression surface 130 or on top of the material being compressed depending on the specific design of the compactor. In alternative embodiments, the waste opening 115 may be closed or physically blocked in order to prevent the addition of additional waste material while the compactor is operating.

Once the compactor has reached a minimum predetermined weight and/or volume threshold, the compactor may notify an operator. This may be accomplished using an indicator, either on the compactor or remotely located, or any other notification device, such as an audible device, a visual notification, email, text, or audio message. In some embodiments, the operator may observe the weight and/or volume display in real time as well as a predicted time range when the compactor will be full in order to facilitate scheduling emptying the compactor.

When the compactor is determined to be full, the operator may empty the compactor in the traditional manner by removing the trash bag or other waste containment device. In certain embodiments, the compactor may be designed to automatically remove the trash bag or other waste containment device from the compactor, seal the bag closed, and/or relocate the full trash container in a convenient storage location so that multiple bags may be picked up at a convenient time.

If the compactor exceeds the maximum predetermined amount of material, the weight indicator 210 or any other notification device may alert the operator to the situation. In certain embodiments, the compactor may be configured to physically block the disposal of additional waste materials into the compressor in order to prevent any complications associated with emptying the compactor in the future. Additionally, the compacting mechanism itself may be disabled if the amount of waste material is determined to have exceeded the maximum capacity of the receptacle. This will allow the operator to safely remove some of the added material before emptying the compactor.

In some embodiments, a camera or imaging device 170 may be used to take periodic pictures of the waste material as it is being disposed in the compactor. Computer vision techniques may be used in order to determine the components of the waste materials. This information may be useful in determining how waste materials should be handled and if there is a percentage of potentially recyclable materials contained within the waste materials. Depending on the circumstances, this information may be utilized to co-locate a recyclable material disposal bin near the compactor in an effort to capture a potentially valuable stream of recyclable materials. Computer vision techniques may also be used to identify unusual material disposed in the receptacle or material that could potentially damage components of the compactor such as pieces of glass, metal, hard plastic, or wood. This information may be used to modify the amount of pressure the compactor uses when compacting the material. For example, if it is determined that only standard food waste has been disposed within the receptacle, there is little danger to the compactor components and a relatively high pressure may be used in order to compact the waste materials. If there is a suspicion that unusual or potentially dangerous material has been disposed of, the compactor may move more slowly and/or use less pressure when compacting the materials. This approach may help prevent materials such as pieces of wire from puncturing the skirt 150 or getting caught in between the edge of the compression surface 130 and the receptacle 110. Additionally, this may prevent damage to the trash bag or other containment device during the compacting process, thus ensuring easy removal of the waste material once the compactor is full.

The data collected by a particular compactor may be used in combination with other collected data and information to analyze the productivity and/or utilization of the compactor, the operator, the staff at a particular location and/or the enterprise across many diverse metrics.

For example, the average number of trash bags full of waste generated at a particular location may be calculated. This information may be correlated with a vast array of information including the amount and type of goods sold at that location. This collected information and calculated information may be compared with other operators, other staff, and/or other locations. That information may be used to increase efficiency, manage staff and/or identify the most and least efficient employees, operators, compactors, and locations.

If a single operator works at multiple locations, comparing the data associated with that operator at each location may reveal logistical issues that allow the operator to work more or less efficiently at a given location.

The person of ordinary skill in the art will understand that the above examples are only a few of the many possible metrics that can be analyzed. There are many additional metrics and procedures that may be analyzed once a sufficient amount of data has been collected.

Data collected may relate to a company, region, branch or location ID; machine ID; employee ID; operator ID; compacted bag ID; product type; sales data; compressed material image; bag count; bag minimum and maximum weight allowed; date and time each bag is compressed; bag weight, type of material being disposed of; source of the material being disposed; compacting time; compacting duration; compacting frequency; compactor emptying time and frequency; compactor inactivity start and end time; compactor inactivity duration; location of the compactor; and/or all relevant compactor settings. All collected data may further be aggregated, analyzed, and compared in order to generate additional data for further analysis.

Additionally, any step in the waste disposal process which requires human data recording or human intervention may be automated, thereby preventing human error and/or potentially increasing efficiency. All collected data may be stored locally but will, preferably, be pushed to a cloud or other database where it can be aggregated and further analyzed. Most preferably, this data will be pushed to a remote database in real time, facilitating the management of enterprise level waste disposal operations and allowing for the optimization of each step in the waste disposal chain.

Disclosed embodiments relate to an apparatus for compacting materials. The apparatus comprises a mechanical linkage designed to be mounted within the interior of an existing waste receptacle, a compression surface operably connected to the mechanical linkage, and a motor operably connected to the mechanical linkage, wherein the motor is capable of moving the compression surface via the mechanical linkage. Disclosed embodiments may further comprise a skirt, wherein the skirt is designed to prevent material from landing on top of the compression surface. Embodiments may further comprise a processor, wherein the processor is arranged and designed to record data relating to compactor operations, a scale operably connected to the processor, wherein the scale is located within the interior of the waste receptacle, an imaging device operably connected to the processor, wherein the imaging device is positioned to capture images of waste material as it is deposited into the receptacle, a printer mounted within the interior of the waste receptacle, a distance sensor capable of monitoring the distance from the sensor to the waste deposited within the receptacle, and/or a volume sensor, arranged to determine the volume of material within the waste receptacle.

In some disclosed embodiments, the processor is programmed to notify an operator if the scale signal is outside of a predetermined range, the processor is programmed to activate the motor, the processor activates the motor based on a predetermined schedule, the processor activates the motor in response to sensor input, and/or the processor is programmed to transfer data to a database. In certain disclosed embodiments, the database is cloud based.

Disclosed embodiments may also relate to a method of converting an existing waste receptacle into a compactor, the method comprising the steps of mounting a mechanical linkage within the receptacle, connecting the mechanical linkage to a compression surface, and connecting the mechanical linkage to a motor, wherein the motor is capable of moving the compression surface via the mechanical linkage. The disclosed method may further comprise installing a processor, wherein the processor is arranged and designed to record data relating to compactor operations, and analyzing the data recorded by the processor and notifying an operator if any data is outside of a predetermined threshold.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

What is claimed is:

1. An apparatus for compacting materials comprising:

a waste receptacle;

a mechanical linkage mounted within the interior of the waste receptacle;

a compression surface having a top operably connected to the mechanical linkage;

a motor operably connected to the mechanical linkage, wherein the motor is capable of moving the compression surface via the mechanical linkage;

a processor;

a printer operably connected to the processor and mounted within the interior of the waste receptacle; and a distance sensor operably connected to the processor to measure the distance from the sensor to a waste deposited within the receptacle and determine an approximate volume of waste deposited in the receptacle;

wherein the compression surface is arranged to tilt as it retracts to allow waste material on the top of the compression surface to fall off the top of the compression surface.

2. The apparatus of claim 1, further comprising a skirt, wherein the skirt prevents material from landing on top of the compression surface.

3. The apparatus of claim 1, wherein the processor is arranged to record data relating to compactor operations.

4. The apparatus of claim 3, further comprising a scale operably connected to the processor, wherein the scale is located within the interior of the waste receptacle.

5. The apparatus of claim 3, further comprising an imaging device operably connected to the processor, wherein the imaging device is positioned to capture images of waste material as it is deposited into the receptacle.

6. The apparatus of claim 3, further comprising a volume sensor, arranged to determine the volume of material within the waste receptacle.

7. The apparatus of claim 4, wherein the processor is programmed to notify an operator if the scale signal is outside of a predetermined range.

8. The apparatus of claim 3, wherein the processor is programmed to activate the motor.

9. The apparatus of claim 8, wherein the processor activates the motor based on a predetermined schedule.

10. The apparatus of claim 8, wherein the processor activates the motor in response to sensor input.

11. The apparatus of claim 3, wherein the processor is programmed to transfer data to a database.

12. The apparatus of claim 11, wherein the database is cloud based.

13. The apparatus of claim 3, further comprising an interior trash container within the interior of the waste receptacle.

14. The apparatus of claim 1, wherein the motor lowers and raises the compression surface.

15. A method of converting an existing waste receptacle into a compactor, the method comprising the steps of:

mounting a mechanical linkage within the existing receptacle;

connecting the mechanical linkage to a compression surface having a top;

connecting the mechanical linkage to a motor, wherein the motor is capable of moving the compression surface via the mechanical linkage;

mounting a printer operably connected to a processor within the interior of the waste receptacle; and mounting a distance sensor within the interior of the waste receptacle, wherein the distance sensor is operably connected to the processor wherein said distance sensor measures the distance from the sensor to a waste deposited within the receptacle and determines an approximate volume of waste deposited in the receptacle;

wherein the compression surface is arranged to tilt as it retracts to allow waste material on the top of the compression surface to fall off the top of the compression surface.

16. The method of claim 15, further comprising recording data relating to compactor operations.

17. The method of claim 16, further comprising analyzing the data recorded by the processor and notifying an operator if any data is outside of a predetermined threshold.

18. The apparatus of claim 1, wherein the printer is a label printer.

19. The apparatus of claim 18, wherein the printer is arranged to print at least one of a barcode, QR code, or RFID chip.

* * * * *